US006766716B1

(12) United States Patent
Lee

(10) Patent No.: US 6,766,716 B1
(45) Date of Patent: Jul. 27, 2004

(54) ADAPTER FOR A RATCHET WRENCH FOR ENGAGING WITH SOCKET OR OTHER TOOLS OF THE LIKE

(76) Inventor: Daniel Lee, No., 62, Jen-Mei Rd., 3Lin, jen-Hua Li, Tali City, Taichung Hsien (TW)

( * ) Notice: Subject to any disclaimer, the term of this patent is extended or adjusted under 35 U.S.C. 154(b) by 0 days.

(21) Appl. No.: 10/446,978

(22) Filed: May 27, 2003

(51) Int. Cl.[7] ..... B25B 13/46

(52) U.S. Cl. ..... 81/60; 81/61; 81/177.85; 81/63.2; 81/177.1; 81/177.2; 403/97; 403/298

(58) Field of Search ..... 81/60, 61, 177.85, 81/63.2, 177.1, 177.2, 180.1; 403/97, 298, 91, 92, 93, 96, 146

(56) References Cited

U.S. PATENT DOCUMENTS 3,533,315 A * 10/1970 Maeda ..... 81/60
4,211,127 A * 7/1980 D'Oporto et al. ..... 81/63
6,216,565 B1 * 4/2001 McCann ..... 81/177.8
6,257,096 B1 * 7/2001 Ling ..... 81/60
6,615,693 B1 * 9/2003 Liao ..... 81/60

* cited by examiner

*Primary Examiner*—Joseph J. Hail, III
*Assistant Examiner*—Alvin J. Grant
(74) *Attorney, Agent, or Firm*—Charles E. Baxley

(57) ABSTRACT

A socket adapter for a ratchet wrench, in which the bottom of the base body of the adapter comprises a coupling portion for engaging with a socket wrench or other liked tools. At the top surface of the base body a locking nut is rotatably disposed for inserting in a drive ratchet of the ratchet wrench. The locking nut is provided with a hexagonal portion at periphery thereof; by rotating the locking nut through a certain angle, the hexagonal portion is accordingly locked manually with any corner of the drive ratchet of the ratchet wrench, such that the socket adapter of the present invention can be detachably fixed in the drive ratchet of the ratchet wrench.

1 Claim, 9 Drawing Sheets

ADAPTER FOR A RATCHET WRENCH FOR ENGAGING WITH SOCKET OR OTHER TOOLS OF THE LIKE

FIELD OF THE INVENTION

The present invention relates to a ratchet wrench, and more particularly to a socket adapter for a ratchet wrench.

DESCRIPTION OF PRIOR ARTS

Conventional ratchet wrenches are generally divided into two types: one is provided with a drive ratchet, and the other is provided with a socket that is replaceable for accommodation of different tool heads. The user has to choose different wrenches according to different tool heads since a socket fits a single size tool head only. Thereby an adapter was invented which is fixed to the ratchet wrench having a drive ratchet at an end, such that the ratchet wrench is additionally provided with a function of socket adapting and thus a single ratchet can perform both functions.

However, in real operation, this kind of adapter has a disadvantage that it cannot be positioned fixedly. Thus, in some special conditions (such as the user sometimes has to lie on the ground for repairing and maintaining machines), the user has to hold the adapter with his hand. Furthermore, this kind of adapter is only applicable to single size socket.

The present invention, mitigates and/or obviates has arisen to mitigate and/or obviate the afore-described disadvantages of the conventional adapter for a ratchet wrench.

SUMMARY OF THE INVENTION

In accordance with one aspect of the present invention, there is a ratchet body of the socket adapter a coupling portion is defined for engaging with a socket or other tools. At top surface of the base body a rotary locking nut is disposed for inserting in a drive ratchet of the ratchet wrench. The locking nut is provided with a hexagonal portion around the periphery thereof, when the locking nut is rotated through a prescribed an angle, the hexagonal portion of the locking nut is accordingly locked mutually with any corner of the drive ratchet of the ratchet wrench and is fixed in position, accordingly, the Such that the socket adapter of the present invention can be removably fixed in the drive ratchet of the ratchet wrench, and through the socket adapter then the ratchet wrench is applicable to socket or other tools.

The primary object of the present invention is to provide a socket adapter for a ratchet wrench. Through the socket adapter the ratchet wrench-can be connected with a socket, so as to augment the versatility of the ratchet wrench.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
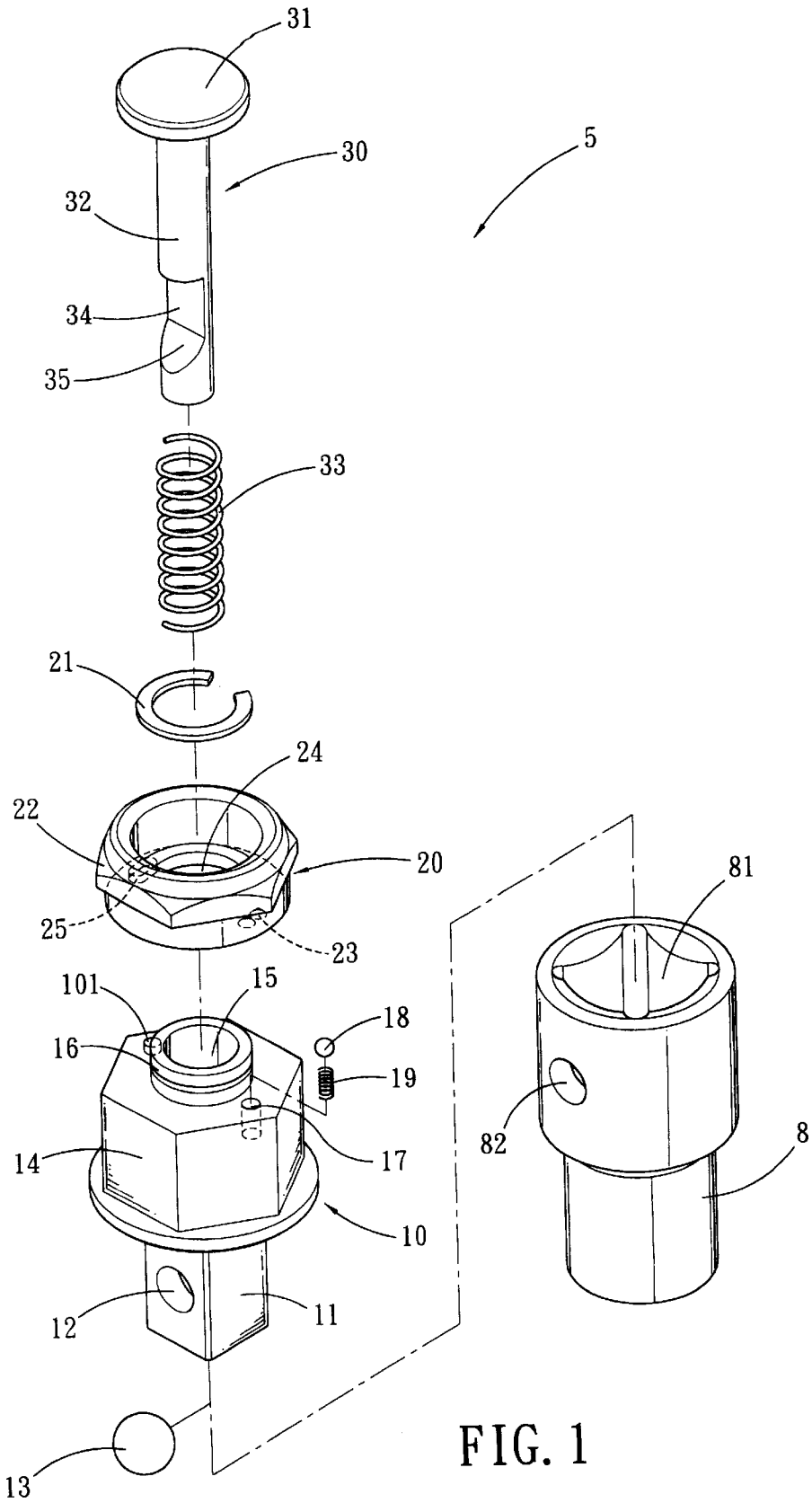
FIG. 1 is an exploded view of an adapter in accordance with a preferred embodiment of the present invention.
Figure 2:
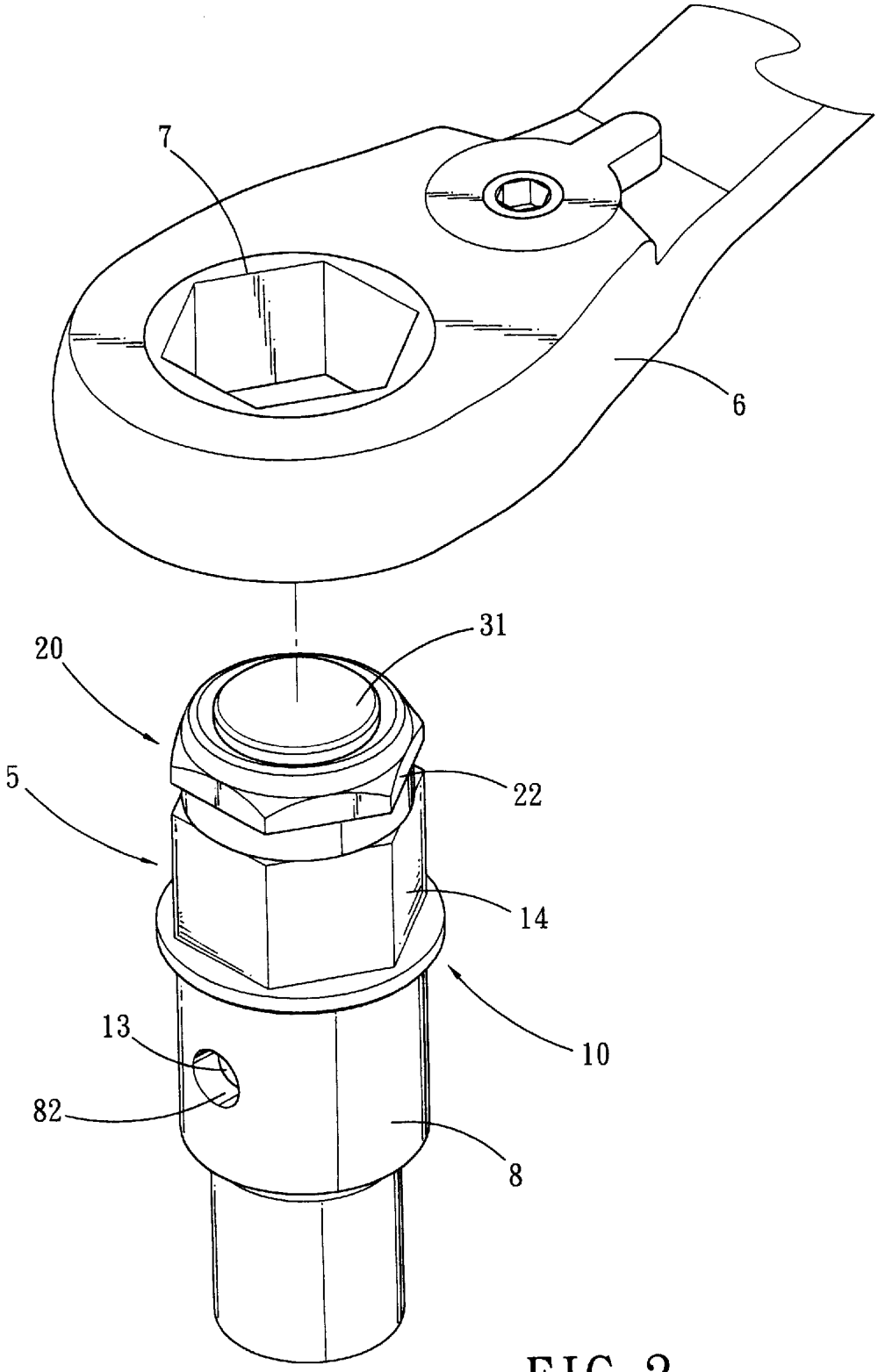
FIG. 2 is an assembly perspective view of the adapter in accordance with a preferred embodiment of the present invention.

Referring first to FIGS. 1–2, wherein a socket adapter 5 for a ratchet wrench in accordance with a preferred embodiment of the present invention is shown and which can be removably engaged in a drive ratchet 7 of a ratchet wrench 6 (for example, a two-way ratchet wrench) through the socket adapter 5 the ratchet wrench 6 is able to engage with a socket or the like (for example, socket 8). The socket adapter 5 comprises a base body 10, a locking nut 20 and a rod 30.

The base body 10 has a coupling portion 11 defined at a first end thereof for engaging with the socket 8. The coupling portion 11 of the base body 10 is pillar-like configured having a predetermined size, while the socket 8 has a slot 81 with a predetermined specification defined at the front end and an aperture 82 defined at a predetermined position thereof. At the coupling portion 11 an aperture 12 is defined for the receipt of a steel ball 13, such that, through the cooperation between the socket 8 and the steel ball 13, the coupling portion 111 of the base body 10 is able to engage with the socket 8 rigidly. At a second end of the base body 10 opposite to the coupling portion 11 an engaging portion 14 is defined for the purpose of engaging with the drive ratchet 7 of the ratchet wrench 6. The engaging portion 14 is axially provided with a through passage 15 for connecting with the aperture 12, around the periphery of the through passage 15 of the engaging portion 14 an annular protrusion 16 is defined and extends outward. At a side of a top surface of the engaging portion 14 is further provided with an orifice 17 for receiving a spring 19 and a ball 18 respectively in turn, such that the ball 18 is pushed by the spring 19 and partially protrudes out of the engaging portion 14 of the base body 10. At another side of the engaging portion 14 opposite to the orifice 17 which is defined with a projection 101.

The locking nut 20 is axially provided with a through hole 24 to be engaged with the engaging portion 14 of the base body 10 by virtue of a c-shape retainer ring 21 mounted onto the annular protrusion 16 of the engaging portion 14. The periphery of the locking nut 20 is defined with a hexagonal portion 22 for mutually engaging with the drive ratchet 7 of the ratchet wrench 6. One side of the bottom of the locking nut 20 is formed with two peripheral notches 23 corresponding to the ball 18 in the base body 10, while at an opposite side of the bottom of the locking nut 20 a groove 25 is formed for receipt of the projection 101 of the base body 10. By such arrangements, after the engaging portion 14 of the base body 10 is inserted in the drive ratchet 7 of the ratchet wrench 6, and followed by rotating the locking nut 20 through a prescribed angle, the hexagonal portion 22 of the locking nut 20 accordingly can be locked with any corner of the drive ratchet 7 of the ratchet wrench 6 and fixed in position. As a result, the locking nut 20 is rigidly positioned in the drive ratchet 7. The rod 30 is provided with a head 31 which is inserted in the through hole 24 of the locking nut 20, the rod 30 is further provided with a rod portion 32 serving to insert in the through passage 15 of the base body 10. A spring 33 is mounted on the rod 30 and at a predetermined position of the rod 30 a notch 34 is defined for accommodation of the steel ball 13 of the base body 10. In the notch 34 is formed a slope 35-, the steel ball 13 is allowed to travel along the slope 35 to roll in or partially protrude out of the coupling portion 11 of the base body 10, such that the user is able to replace the socket by pushing the push head 31 of the rod 30.

Figure 3:
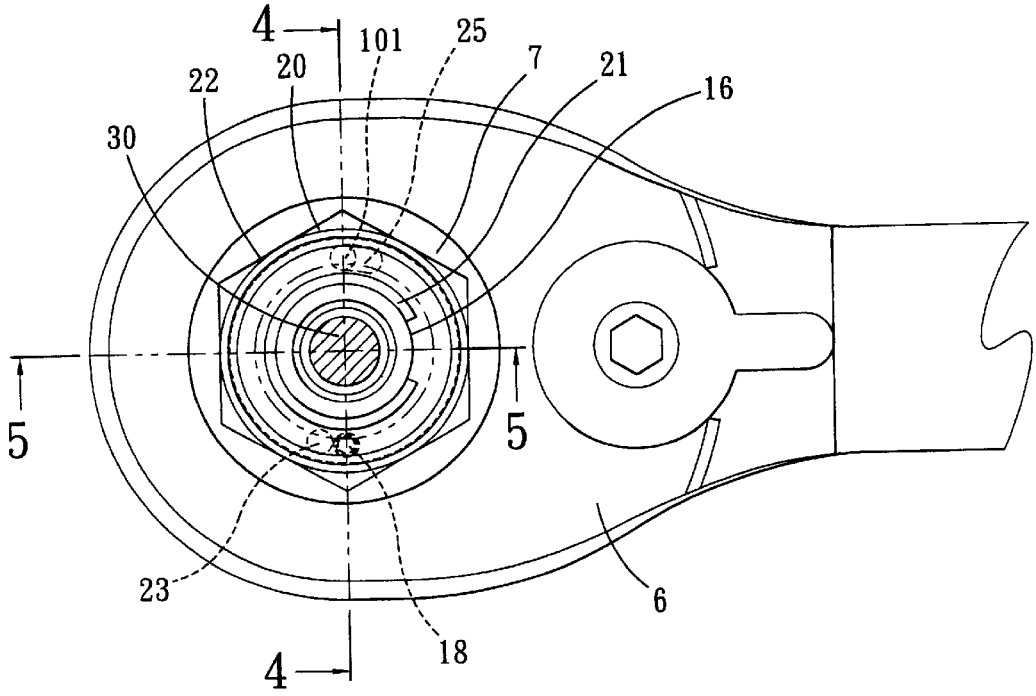
FIG. 3 is a top view in accordance with a preferred embodiment of the present invention of showing the adapter engaging in a ratchet wrench.
Figure 4:
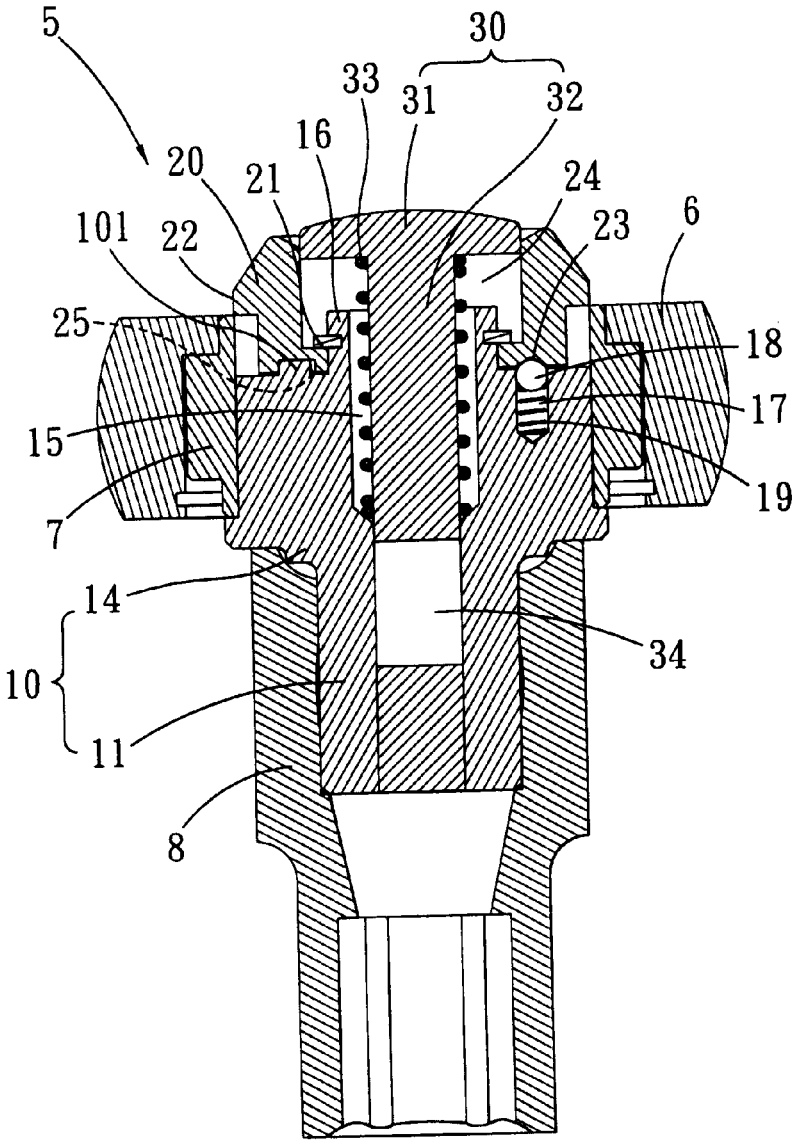
FIG. 4 is a cross sectional view taken along 4—4 of FIG. 3.
Figure 5:
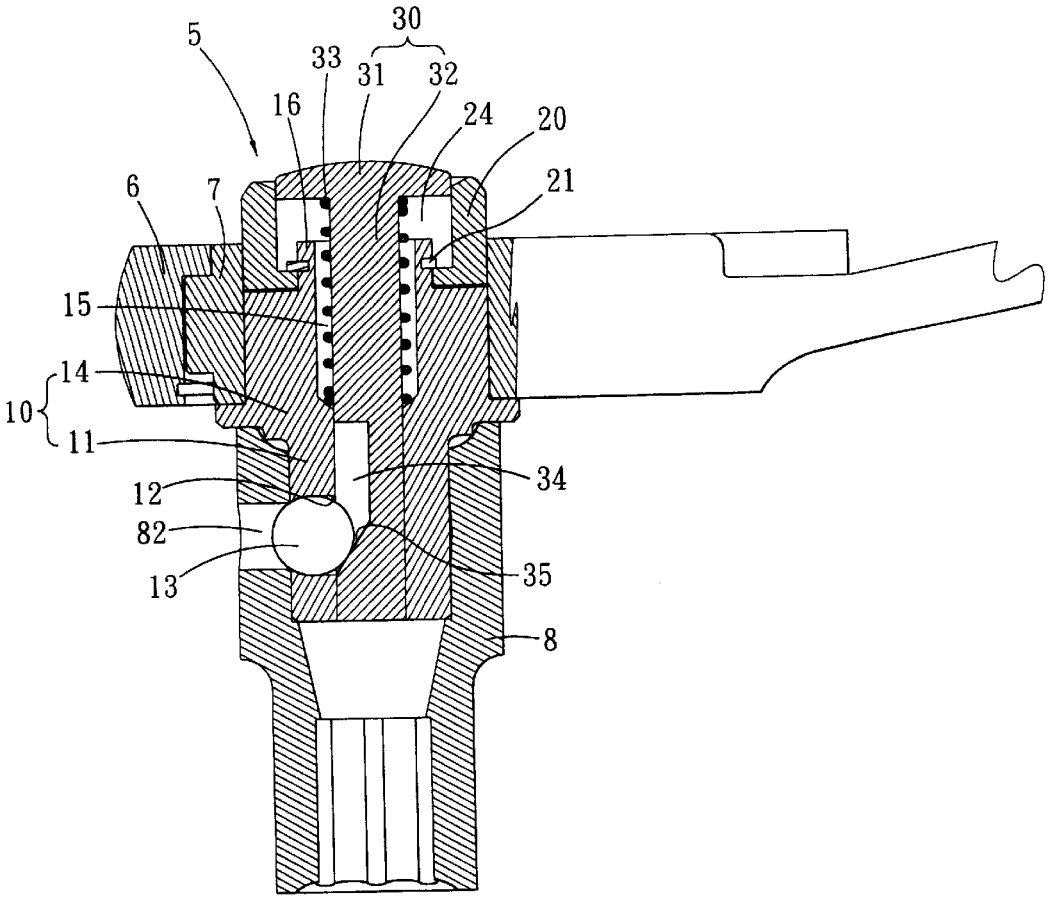
FIG. 5 is a cross sectional view taken along 5—5 of FIG. 3.
Figure 6:
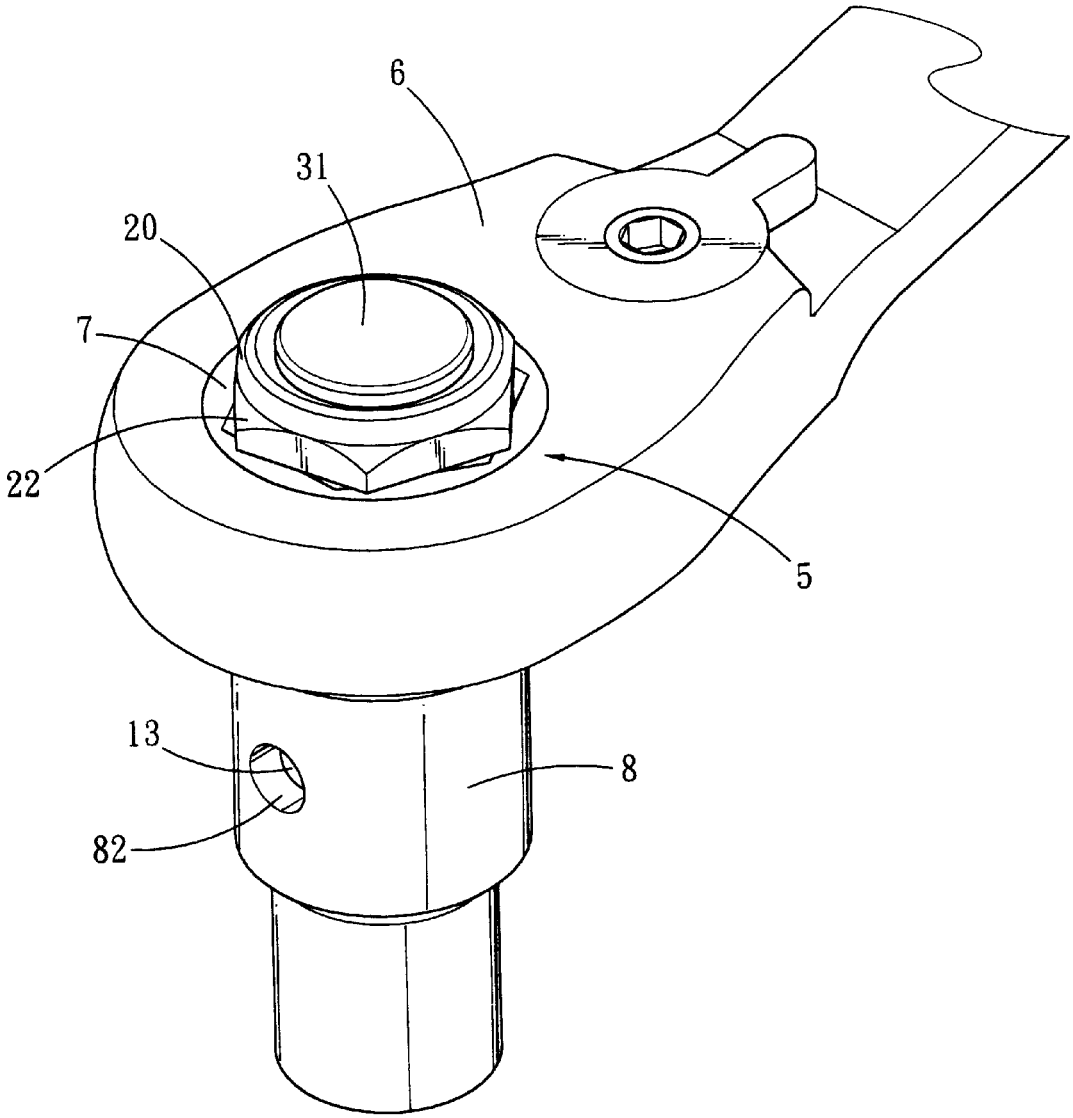
FIG. 6 is a perspective view in accordance with a preferred embodiment of the present invention showing the adapter being engaged with a ratchet wrench.
Figure 7:
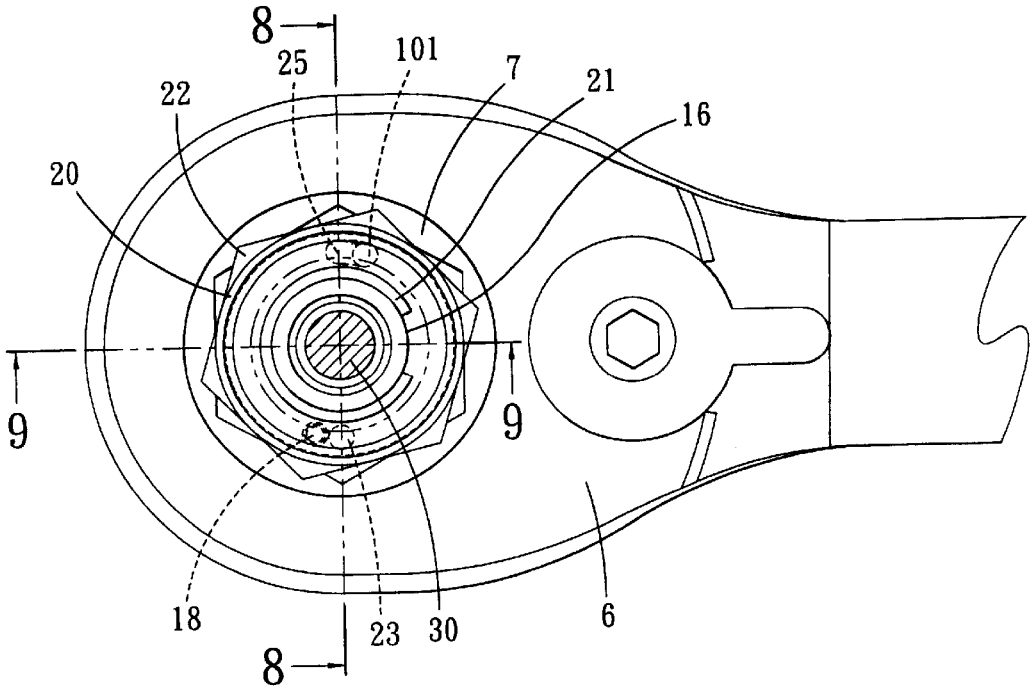
FIG. 7 is a top view of FIG. 6.
Figure 8:
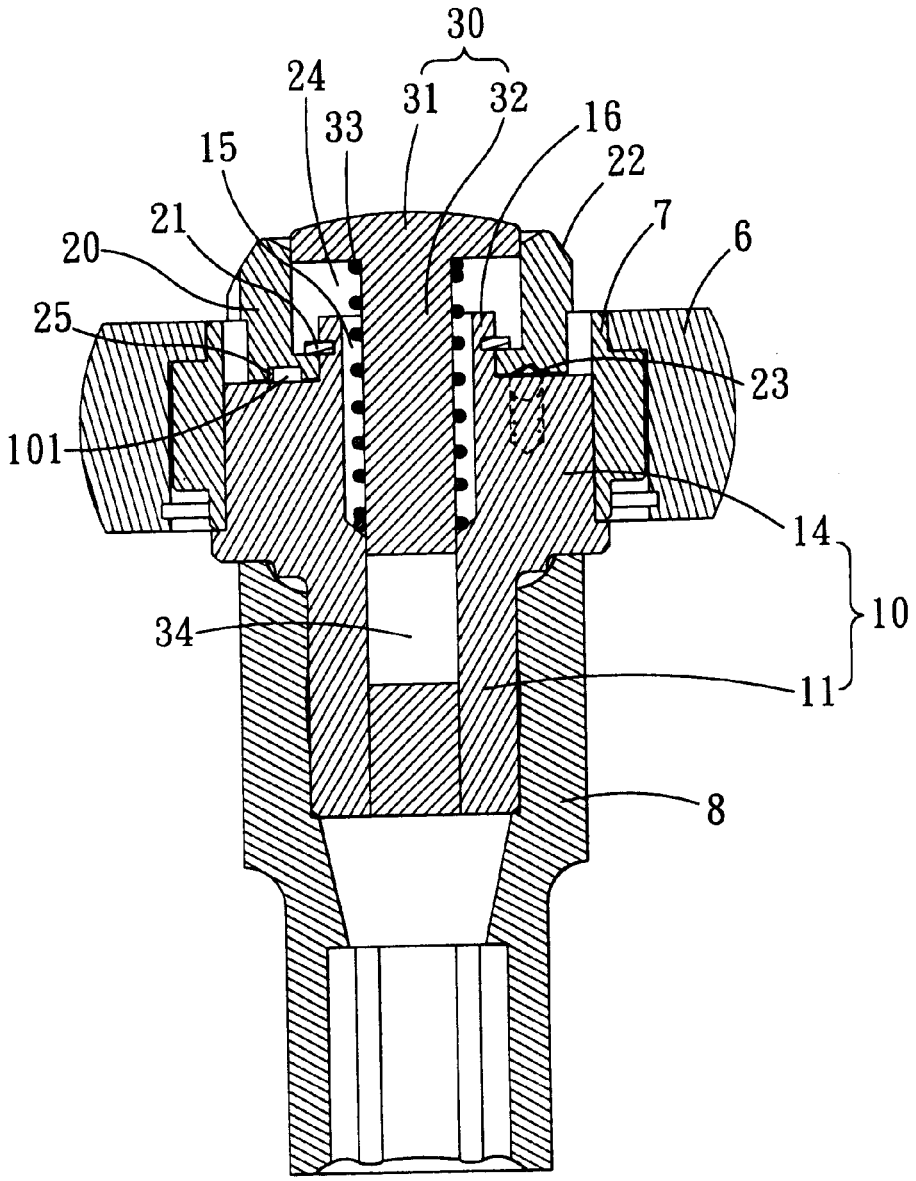
FIG. 8 is a cross sectional view taken along 8—8 of FIG. 7.
Figure 9:
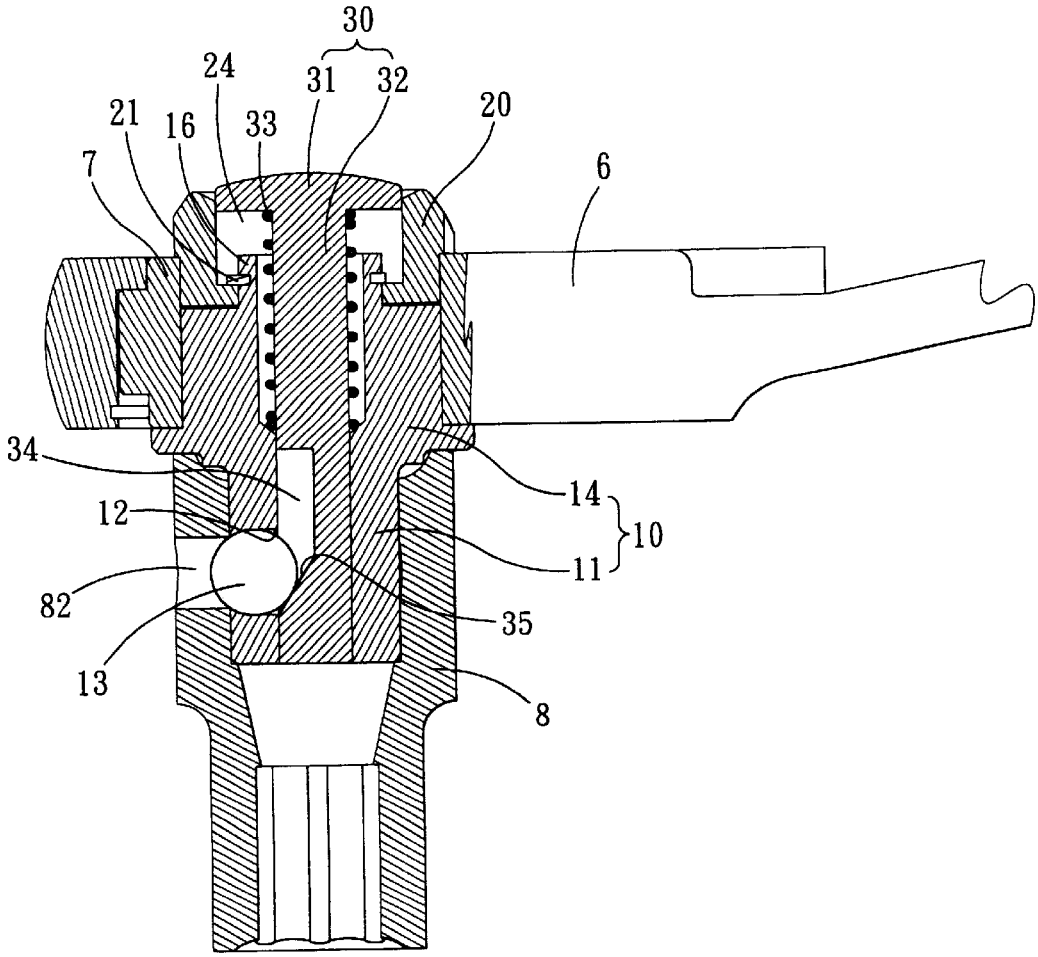
FIG. 9 is a cross sectional view taken along 9—9 of FIG. 7.

Referring now to FIGS. 2–9, In order to assemble the adapter 5 to the ratchet wrench 6, insert the adapter 5 in the drive ratchet 7 of the ratchet wrench 6 so as to make the engaging portion 14 of the base body 10 engage in the drive ratchet 7 of the ratchet wrench 6, and insert the locking nut 20 of the adapter 5 through the drive ratchet 7 of the ratchet wrench 6, as shown in FIGS. 3–5.

The user then rotates the locking nut 20 of the socket adapter 5 a certain angle, as shown in FIGS. 6–9, so as to make the hexagonal portion 22 of the locking nut 20 mutually lock with a comer of the drive ratchet 7 of the ratchet wrench 6. The locking nut 20 has two peripheral notches 23 defined at a side of the bottom serves to engage with the ball 18 of the base body 10, thereby the locking nut 20 can be positioned after the locking nut 20 is rotated a certain degree. Furthermore, θ another side of the bottom of the locking nut 20 is defined with the groove 25 for insertion of the projection 101 of the base body 10, such that the locking nut 20 is rigidly positioned in the drive ratchet 7. As a result, the socket adapter 5 can be fixed in the ratchet wrench 6 firmly. Through the socket adapter 5, the ratchet wrench 6 can be equipped with different sockets. On the other hand, in order to remove the socket adapter 5, the user only needs to reversely rotate the locking nut 20 of the socket adapter 5 a prescribed angle, so as to make the hexagonal portion 22 fully match the drive ratchet 7 of the ratchet wrench 6, thus the socket adapter 5 can be disassembled from the ratchet wrench 6 without difficulties.

It will be noted that, besides the socket 8, the coupling portion 11 of the socket adapter 5 can engage with other tool head of the like so as to increase the applicability of the ratchet wrench.

While we have shown and described various embodiments in accordance with the present invention, it should be clear to those skilled in the art that further embodiments may be made without departing from the scope of the present invention.

What is claimed is:

1. A socket adapter detachably fixed to a drive ratchet of a ratchet wrench, through the adapter the ratchet wrench being able to engage with a socket or drive output tools, the socket adapter comprising:

a base body including a coupling portion defined at a first end of the base body for engaging with a socket, and a locking nut disposed at a second end of the base body of the socket adapter for inserting in the drive ratchet of the ratchet wrench, a periphery of the locking nut is formed with a hexagonal portion, the locking nut being rotatable relative to the base body, wherein upon rotation of the locking nut the hexagonal portion being lockable mutually with the drive ratchet such that the socket adapter is detachably engaged in the drive ratchet of the ratchet wrench.

* * * * *